US010654160B2

(12) United States Patent
Chen et al.

(10) Patent No.: US 10,654,160 B2
(45) Date of Patent: May 19, 2020

(54) NAIL GUN RECOIL BUMPER

(71) Applicants: Helen Y. Chen, Aurora, IL (US); Kevin J. Stanger, Belvidere, IL (US)

(72) Inventors: Helen Y. Chen, Aurora, IL (US); Kevin J. Stanger, Belvidere, IL (US)

(73) Assignee: Miner Elastomer Products Corporation, Geneva, IL (US)

( * ) Notice: Subject to any disclaimer, the term of this patent is extended or adjusted under 35 U.S.C. 154(b) by 202 days.

(21) Appl. No.: 15/628,506

(22) Filed: Jun. 20, 2017

(65) Prior Publication Data

US 2018/0361560 A1 Dec. 20, 2018

(51) Int. Cl.

| | |
|---|---|
| ***B25F 5/00*** | (2006.01) |
| ***B25C 1/04*** | (2006.01) |
| ***B25C 1/00*** | (2006.01) |
| *B25C 1/06* | (2006.01) |

(52) U.S. Cl.

CPC ..... *B25F 5/006* (2013.01); *B25C 1/008* (2013.01); *B25C 1/047* (2013.01); *B25C 1/04* (2013.01); *B25C 1/06* (2013.01)

(58) Field of Classification Search

CPC ..... B25F 5/006; B25C 1/047; B25C 1/008; B25C 1/06; B25C 1/04

USPC ..... 227/8, 131, 120, 156

See application file for complete search history.

(56) References Cited

U.S. PATENT DOCUMENTS

| | | | | |
|---|---|---|---|---|
| 3,496,840 | A * | 2/1970 | Dorney | B25C 1/047 92/85 R |
| 5,025,971 | A * | 6/1991 | Schafer | B25C 1/047 227/130 |
| 6,779,698 | B2 * | 8/2004 | Lin | B25C 1/08 173/210 |
| 8,544,561 | B2 * | 10/2013 | Aihara | B25C 1/047 173/162.1 |
| 2008/0006671 | A1 * | 1/2008 | Yang | B25C 1/047 227/130 |
| 2010/0155097 | A1 * | 6/2010 | Krondorfer | B25C 1/047 173/210 |

(Continued)

*Primary Examiner* — Hemant Desai
*Assistant Examiner* — Christopher Robin Kim
(74) *Attorney, Agent, or Firm* — Law Office of John W. Harbst

(57) ABSTRACT

A recoil bumper for a nail gun having a body, an axially elongated cylinder disposed within the body of the nail gun, a piston slidably movable in the cylinder, and a driver having a multi-sided cross-sectional configuration, in plan, axially extending along at least a lengthwise portion thereof. The recoil bumper includes a hollow elastomeric member through which the lengthwise portion of the driver endwise passes. The elastomeric member has first and second end faces axially spaced from each other. The first end abuts with the nail gun body while the piston impacts against the second end face during operation of the nail gun. The first end face of said elastomeric member defines a first opening. The second end face of the elastomeric member defines a closed marginal edge for a second opening. The closed marginal edge of the second opening generally corresponds in size and shape to the multi-sided cross-sectional configuration of the lengthwise portion of the driver passing therethrough such that an impact area defined by the second end face of the bumper is optimized to absorb energy imparted thereto by the piston during operation of the nail gun.

34 Claims, 4 Drawing Sheets

(56) References Cited

U.S. PATENT DOCUMENTS

| | | | | |
|---|---|---|---|---|
| 2010/0243286 | A1* | 9/2010 | Hoshino | B25C 1/047<br>173/211 |
| 2015/0135946 | A1* | 5/2015 | Mina | B25C 1/041<br>92/85 R |
| 2015/0375381 | A1* | 12/2015 | Tanji | B25F 5/006<br>227/146 |
| 2016/0229043 | A1* | 8/2016 | Wyler | B25C 1/06 |
| 2018/0126527 | A1* | 5/2018 | Pomeroy | B25C 1/008 |
| 2018/0126528 | A1* | 5/2018 | Pomeroy | B25C 1/008 |
| 2018/0133877 | A1* | 5/2018 | Ueda | B25F 5/008 |
| 2018/0178361 | A1* | 6/2018 | Kabbes | B25C 1/06 |
| 2018/0222032 | A1* | 8/2018 | Cheng | B25F 5/006 |
| 2018/0361560 | A1* | 12/2018 | Chen | B25F 5/006 |
| 2019/0022842 | A1* | 1/2019 | Oouchi | B25C 1/04 |
| 2019/0111552 | A1* | 4/2019 | Nagao | B25C 1/04 |

* cited by examiner

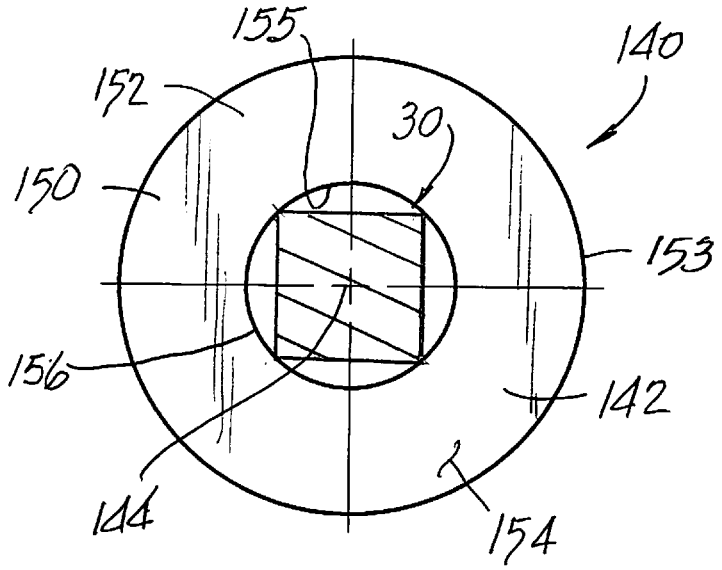
FIG. 5
FIG. 6
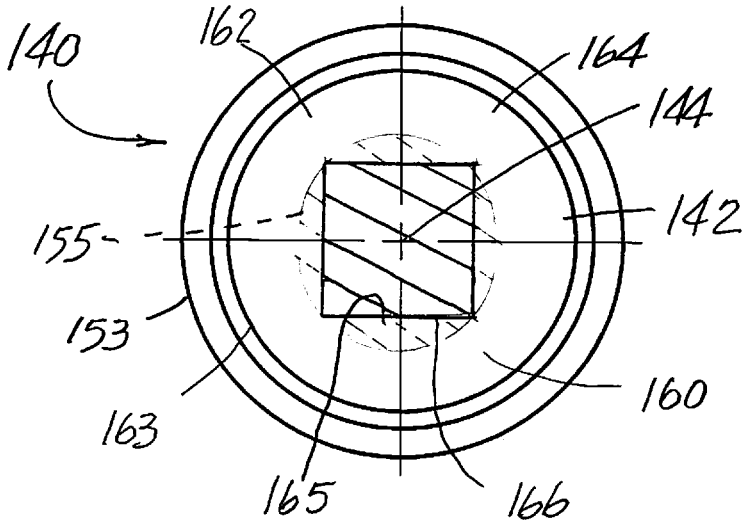

NAIL GUN RECOIL BUMPER

FIELD OF THE INVENTION DISCLOSURE

The present invention disclosure relates to a nail gun and, more particularly, to a recoil bumper for a nail gun.

BACKGROUND

A conventional nail gun has a gun body with an axially elongated cylinder disposed therewithin. A piston is arranged for sliding movements within the cylinder and is operably connected to a driver. The driver has a predetermined cross-sectional configuration extending along a significant lengthwise portion thereof. Typically, the predetermined cross-sectional configuration of the driver is multisided. That is, the multi-sided cross-sectional configuration of the driver is typically in the shape of an oval, triangle, square, rectangle or other suitable shape having more than four sides.

When the nail gun is operated, the piston is forcibly driven from a raised position in the cylinder to a lower position in the cylinder. As the piston moves toward its lowered position, a free end of the driver moves outwardly of the gun body to hit or strike a nail or other suitable fastener. The piston normally returns along with the driver to the raised position after the nail gun is fired.

In an effort to control impact forces, a recoil bumper is typically arranged in the gun body toward the lower end of travel of the piston. The recoil bumper is designed to allow a lengthwise portion of the driver to endwise pass therethrough. If the nail gun misfires (as when the free end of the driver fails to engage or otherwise contact with a nail or fastener), the full impact of the downwardly moving piston is imparted to the nail gun bumper and can result in significant damage to the recoil bumper.

Thus, there is a need and continuing desire for a nail gun recoil bumper which can absorb the forces of the forcibly driven piston repeatedly impacting thereagainst and is designed to prolong the useful life of the bumper thereby improving overall performance of the nail gun

SUMMARY

In view of the above, and in accordance with one aspect of this invention disclosure, there is provided a recoil bumper for a nail gun having a body, an axially elongated cylinder disposed within the body of the nail gun, a piston slidably movable in the cylinder, and a driver having a multi-sided cross-sectional configuration, in plan, axially extending along at least a lengthwise portion thereof. One end of the driver protrudes out of the gun body for punching against a nail in accordance with downward movement of the piston. The recoil bumper includes a hollow elastomeric member through which the lengthwise portion of the driver endwise passes. The elastomeric member has a first end face which abuts with the nail gun body and a second end face axially spaced from the first end face and against which the piston impacts during operation of the nail gun. The first end face of said elastomeric member defines a closed marginal edge for a first opening. The second end face of the elastomeric member defines a closed marginal edge for a second opening. The closed marginal edge of the second opening generally corresponds in size and shape to the multi-sided cross-sectional configuration of the lengthwise portion of the driver passing therethrough such that an impact area defined by the second end face of the bumper is optimized to absorb energy imparted thereto by the piston during operation of the nail gun.

In one form, the elastomeric member defines a longitudinal axis for the bumper, with the first and second openings defined by the elastomeric member being coaxially aligned relative to the longitudinal axis of the bumper. Preferably, the first and second openings defined by the elastomeric member have different marginal edge configurations relative to each other. In one form, the second opening defined by the elastomeric member has a generally oblong marginal edge configuration, in plan. In another form, the second opening defined by the elastomeric member has a generally square marginal edge configuration, in plan. In yet another embodiment, the second opening defined by the elastomeric member has a generally triangular marginal edge configuration, in plan. In still another form, the second opening defined by the elastomeric member has a generally rectangular marginal edge configuration, in plan.

Preferably, the elastomeric member is formed from a one-piece thermoplastic elastomer having a Shore D hardness ranging between about 40 and 70. The first and second end faces of said elastomeric member are axially separated from each other by an axially elongated energy absorbing section. In one form, the axially elongated energy absorbing section of the elastomeric member comprises between about 45% and about 70% of an overall length of the recoil bumper. In one embodiment, the axially elongated energy absorbing section of the recoil bumper is in the form of a ring whose lateral outer face is curved outwardly toward an exterior of the bumper. Preferably, the axially elongated energy absorbing section of the recoil bumper has a wall with a generally constant cross-sectional thickness.

According to another aspect of the invention disclosure, there is provided a recoil bumper for a nail gun having a body with an axially elongated cylinder disposed within the body of the nail gun. A piston is slidably movable in the cylinder. A driver having a multi-sided cross-sectional configuration axially extending along at least a lengthwise portion thereof is operably moved by and with the piston. One end of the driver protrudes out of the gun body for punching against a nail in accordance with downward movement of the piston. The recoil bumper includes an axially elongated hollow elastomeric member through which a lengthwise portion of the driver endwise passes. The elastomeric member has first and second ends with an axially elongated energy absorption section extending therebetween. The first end of the elastomeric member defines a first end face adapted to operably abut with the nail gun body. The second end of the elastomeric member defines a second end face against which the piston impacts during operation of the nail gun. The first end face of the elastomeric member defines a closed marginal edge for a first opening. The second end face of the elastomeric member defines a closed marginal edge for a second opening. The closed marginal edge of the second opening generally corresponds in size and shape to the multi-sided cross-sectional configuration of the lengthwise portion of the driver passing therethrough such that an impact area defined by the second end face of the elastomeric member is optimized to absorb energy imparted thereto by the piston during operation of the nail gun.

The elastomeric member defines a longitudinal axis for the nail gun bumper. Preferably, the first and second openings defined by the elastomeric member are coaxially aligned relative to the longitudinal axis of the bumper.

Preferably, the first and second openings defined by the elastomeric member have different marginal edge configurations relative to each other. In one embodiment, the second opening defined by the elastomeric member has a generally oblong marginal edge configuration, in plan. In another embodiment, the second opening defined by the elastomeric member has a marginal edge configuration including four or more sides, in plan. In still another embodiment, the second opening defined by the elastomeric member has a generally triangular marginal edge configuration, in plan.

In a preferred embodiment, the elastomeric member is formed from a one-piece thermoplastic elastomer having a Shore D hardness ranging between about 40 and 70. Preferably, the axially elongated energy absorbing section comprises between about 45% and about 70% of an overall length of the recoil bumper. In one embodiment, the axially elongated energy absorbing section of the recoil bumper is in the form of a ring whose lateral outer face is curved outwardly toward an exterior of the bumper. Moreover, in one form, the axially elongated energy absorbing section of the recoil bumper has a wall with a generally constant cross-sectional thickness.

According to another aspect of this invention disclosure, there is provided a recoil bumper for a nail gun having a body, an axially elongated cylinder arranged within the body of the nail gun with a piston slidably movable within the cylinder. An axially elongated driver is operably connected to the piston. The driver has a multi-sided cross-sectional configuration axially extending along at least a lengthwise portion thereof. One end of the driver protrudes out of the gun body for punching against a nail in accordance with downward movements of the piston. The recoil bumper includes an elongated and rigid elastomeric member through which a lengthwise portion of the driver endwise passes. The elastomeric member also has a first end and a second end and defines an interior chamber. The elastomeric member has end structure at each of the first and second ends for at least partially closing the interior chamber at the first and second ends. The end structure at the first end of the elastomeric member abuts against the nail gun body and defines a closed marginal edge for a first opening. The end structure at the second end of the elastomeric member abuts with the piston during operation of the nail gun and defines a closed marginal edge for a second opening. The closed marginal edge of the second opening generally corresponds in size and shape to the multi-sided cross-sectional configuration of the lengthwise portion of the driver passing therethrough such that an impact area defined by the end structure at the second end of the elastomeric member is optimized to absorb energy imparted thereto by the piston during operation of the nail gun.

In one form, the elastomeric member defines a longitudinal axis for the recoil bumper. Preferably, the first and second openings defined by the elastomeric member are coaxially aligned relative to the longitudinal axis of the bumper. In a preferred embodiment, the first and second openings defined by the first and second end structures, respectively, of the elastomeric member have different marginal edge configurations relative to each other. In one embodiment, the second opening defined by the second end structure of the elastomeric member has a generally oblong marginal edge configuration, in plan. In another embodiment, the second opening defined by the second end structure of the elastomeric member has a marginal edge configuration with four or more sides, in plan. In yet another embodiment, the second end structure of the elastomeric member has a generally triangular marginal edge configuration, in plan.

In a preferred form, the elastomeric member is formed from a one-piece thermoplastic elastomer having a Shore D hardness ranging between about 40 and 70. In a preferred embodiment, the first and second end structures of the elastomeric member are axially separated from each other by an axially elongated energy absorbing section. The axially elongated energy absorbing section preferably comprises between about 45% and about 70% of an overall length of the recoil bumper. In one embodiment, the axially elongated energy absorbing section of the recoil bumper is in the form of a ring whose lateral outer face is curved outwardly toward an exterior of said bumper. Preferably, the axially elongated energy absorbing section of the recoil bumper has a wall with a generally constant cross-sectional thickness.

BRIEF DESCRIPTION OF THE DRAWINGS

FIG. 5 is a bottom plan view similar to FIG. 3 but showing another form of recoil bumper embodying principals and teachings of this invention disclosure;

FIG. 6 is a top plan view of the recoil bumper illustrated in FIG. 5;

DETAILED DESCRIPTION

Figure 1:
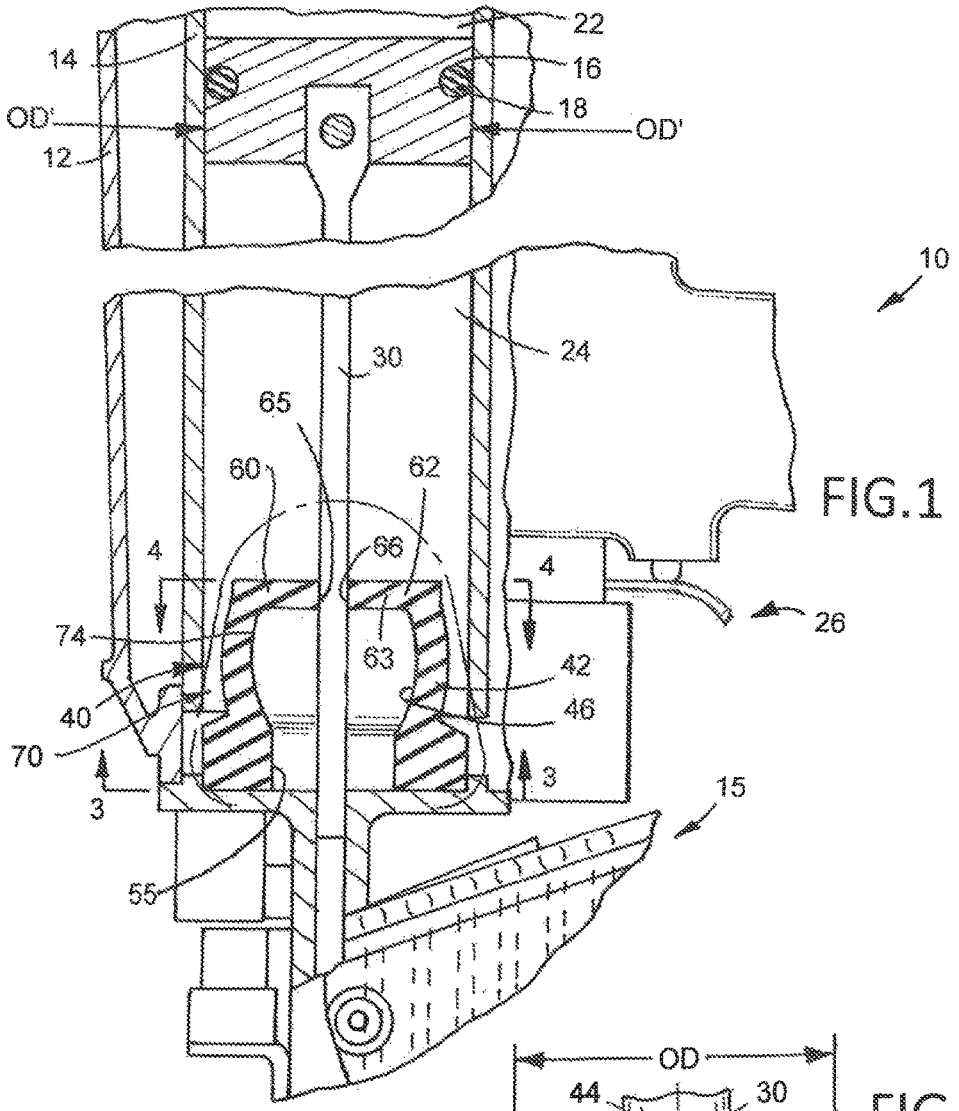
FIG. 1 is a fragmentary sectional view of a portion of a nail gun which embodies features of the present invention disclosure in combination therewith.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, there is shown in FIG. 1 a pneumatically operated nail gun, generally indicated by reference numeral 10. The pneumatically operated nail gun 10 illustrated in the drawings is merely for exemplary for exemplary purposes, and it will be appreciated the teachings and principals of this invention disclosure relate to a wide range of nail guns including but not limited to pneumatically operated nail guns but also those which are electrically operated. Moreover, and although the device 10 shown by way of example in FIG. 1 is intended to hit or otherwise impact with nails, it will be appreciated the teachings and principals of this invention disclosure equally apply to other types of devices used to drive or strike other types of fasteners without detracting or departing from the true spirit and scope of this invention disclosure.

In the embodiment illustrated in FIG. 1 for exemplary purposes, the nail gun 10 includes a gun body 12, an axially elongated cylinder 14 in the gun body 12 and a hitting piston 16 disposed for sliding reciprocal movements in the cylinder 14. In the illustrated embodiment, the nail gun 10 further includes a magazine 15 for holding a supply of nails or other suitable fasteners. In the illustrated embodiment, piston 16 includes one or more air tight rings or seals 18 which operably divide the cylinder 14 into an upper chamber 22 and a bottom chamber 24 when the hitting piston 16 moves downward to hit or strike nails or the like or move upward to reposit. Typically, the gun body 12 defines passages (not shown) for directing forced gas and/or air to chambers 22 and 24 in response to operation of a manual trigger assembly 26.

An axially elongated driver 30 is either monolithically formed with or is operably connected to and depends from the piston 16. The driver 30 is typically formed from a highly rigid material, such as steel and the like, and serves as a rigid driving member for nail gun 10. A free-end of the driver 30 protrudes out of the gun body 12 for punching against a nail in accordance with a downward movement of the piston 16. As described in further detail below, the driver 30 has a multi-sided cross-sectional configuration axially extending along a major lengthwise portion thereof.

As illustrated in FIG. 1, a one-piece recoil bumper or piston bumper, generally indicated by reference numeral 40, is provided in the body 12 of and in operable combination with the nail gun 10. More specifically, the recoil bumper 40 is disposed toward a lower end of the elongated cylinder 14 and is provided in the vicinity of a lower dead point of the piston 16. The piston bumper 40 is made as a rigid hollow elastomeric member 42 and serves to absorb impacts or energy (excess energy) obtained by subtracting energy which has been consumed by the driving of the nail from a driving energy contained in the piston 16 which has been forcibly descended by the driving force propelling piston 16 toward the dead end point of its downward travel. As illustrated in FIG. 1, the hollow configuration of the elastomeric member 42 surrounds and permits a lengthwise portion of the driver 30 to endwise pass therethrough.

The elastomeric member 42 has a generally cylindrical-like, hollow and axially elongated configuration with a lengthwise portion of the driver 30 extending and endwise moving therethrough and defines a longitudinal axis 44 for bumper 40. Preferably, member 42 is formed from a one-piece thermoplastic elastomer having as Shore D hardness ranging between about 40 and about 70. In a most preferred embodiment, the elastomeric member 42 is formed from a one-piece thermoplastic elastomer having as Shore D hardness ranging between about 50 and about 55

Figure 2:
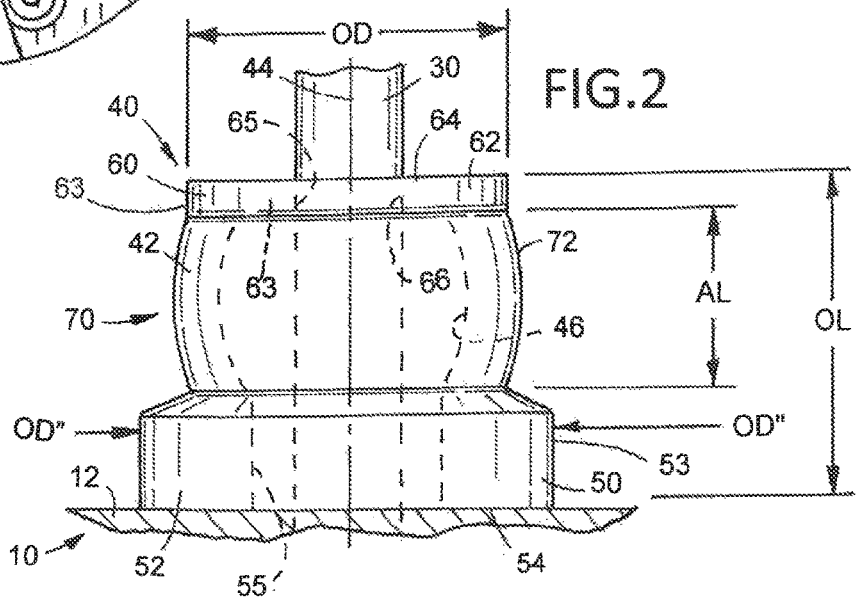
FIG. 2 is an enlarged elevational view of the area encircled in phantom lines FIG. 1.

Turning to FIG. 2, the elastomeric member 42 has a first end 50 and axially spaced second end 60 and defines an interior chamber 46 (FIG. 1) between the ends 50 and 60. The first end 50 of member 42 includes end structure 52 defining a generally flat or planar first end face 54 which is adapted to abut against and with a confronting surface on the nail gun body 12 (FIG. 1). The second end 60 of member 42 includes end structure 62 defining a generally flat or planar second end face 64 axially spaced from the end face 54 and against which the piston 16 (FIG. 1) impacts during operation of the nail gun 10. In the embodiment illustrated in FIG. 2, the first end structure 52 of bumper 10 has an outer diameter 53 which is greater in diameter than is the outer diameter 63 of the second end structure 62 of bumper 10. The first and second end structures 52 and 62, respectively, of member 42 at least partially close the interior chamber 46 at the first and second ends 50 and 60, respectively, of member 42.

The first and second end faces 54 and 64 of the elastomeric member 42 are axially separated from each other. The axial distance between the first and second end faces 54 and 64 of the elastomeric member 42 define an overall length OL for the recoil or impact bumper 10. In a preferred form, the first and second end faces 54 and 64 of the elastomeric member 42 are axially separated from each other by an axially elongated energy absorbing section 70.

In a preferred form of the invention disclosure, the first end 50 of the elastomeric member 42 has an outer diameter OD which is equal to or less than the outer diameter OD' of the piston 16 (FIG. 1). Moreover, and to add stability to the recoil bumper 40 after being installed, the second end 60 of the elastomeric member 42 preferably has an outer diameter OD" which is greater than the outer diameter OD of the first end 50 of the elastomeric member 42.

In an exemplary illustration of this invention disclosure shown in FIG. 2, the axially elongated energy absorbing section 70 of the recoil or impact bumper 10 has an axial length AL comprising about 45% to about 70% of the overall length OL of the recoil or impact bumper 10. Preferably, the axially elongated energy absorbing section 70 of the recoil or impact bumper 10 is in the form of a ring whose lateral outer face 72 in curved outwardly toward an exterior of the bumper 10. The axially elongated energy absorbing section 70 of the recoil or impact bumper 10 has a wall 74 (FIG. 1) preferably having a generally constant cross-sectional thickness for the length thereof. In one form of the invention disclosure, the axially elongated energy absorbing section 70 has an outer diameter which is about equal to or greater than the outer diameter OD of the outer diameter OD of the first end 50 of the elastomeric member 42 but less than the outer diameter OD" of the second end 60 of the elastomeric member 42 of bumper 40.

Figure 3:
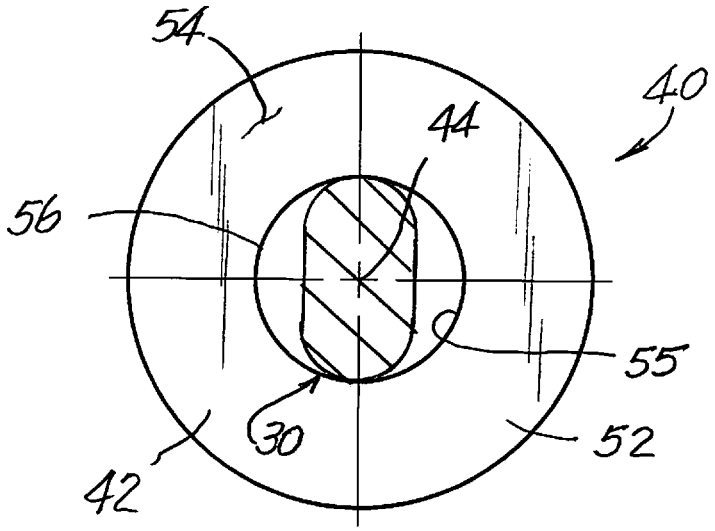
FIG. 3 is a bottom plan view taken along line 3-3 of FIG. 1 showing the recoil bumper illustrated in FIG. 2.
Figure 4:
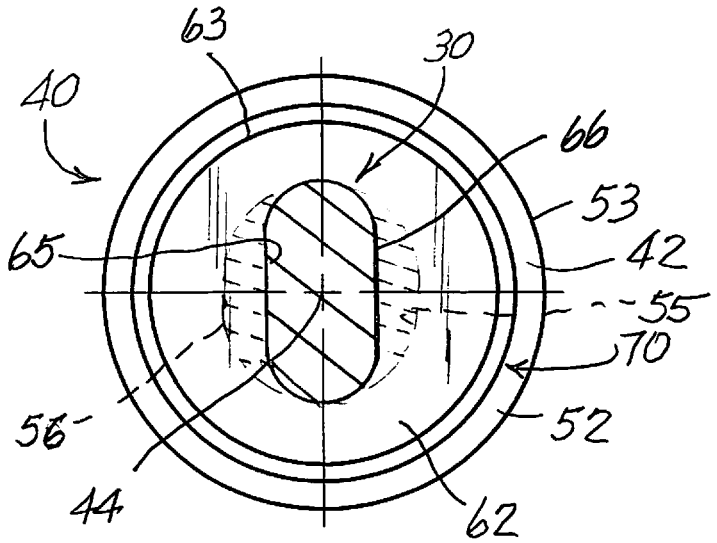
FIG. 4 is a top plan view taken along line 4-4 of FIG. 1 showing the recoil bumper illustrated in FIG. 2.

To allow a lengthwise portion of the driver 30 to extend through the bumper 40, the first and second end structures 52 and 62, respectively, of member 42 each define a first opening 55 and second opening 65, respectively, which open to both the hollow chamber 46 of member 42 and to the first and second end faces 54 and 64, respectively, of member 42. As illustrated in FIG. 3, the first opening 55 defined by the end structure 52 and end face 54 of the elastomeric member 42 has a closed marginal edge 56 which is sized to allow the predetermined cross-sectional configuration of the driver 30 to endwise move therethrough. As illustrated in FIG. 4, the second opening 65 defined by the end structure 62 and end face 64 of the elastomeric member 42 has a closed and multi-sided marginal edge 56 which is sized to allow the predetermined cross-sectional configuration of the driver 30 to endwise move therethrough.

As illustrated in FIGS. 1 and 2, the end structure 62 at the second end 60 of the elastomeric member 42 preferably includes, as an integral part thereof, lip structure 63 extending radially inward from an upper end of the axially elongated energy absorbing section 70. As shown, the lip structure 63 extends radially inward from the absorbing section 70 of the bumper 10 and terminates at the marginal edge 66 of the second opening 65.

Typically, the configuration of the closed marginal edge 66 of opening 65 defined by the end structure 62 and end face 64 of the elastomeric member 42 generally corresponds to the configuration of the closed marginal edge 56 of opening 55 defined by the end structure 52 and end face 54 of the elastomeric member 42. With the present invention disclosure, however, the configuration of the closed and multi-sided marginal edge 66 of opening 65 defined by the end structure 62 and end face 64 of the elastomeric member 42 is different in both size and shape from the configuration of the marginal edge 56 of opening 55 defined by the end structure 52 and end face 54 of the elastomeric member 42. More specifically, the configuration of the closed marginal edge 66 of opening 65 defined by the end structure 62 and end face 64 of the elastomeric member 42 has a multi-sided configuration generally corresponding in size and shape to the multi-sided cross-sectional configuration of the lengthwise portion of the drive passing therethrough.

The advantage to be realized by configuring the closed marginal edge 66 of opening 65 defined by the end structure 62 and end face 64 of the elastomeric member 42 to generally correspond in size and shape to the multi-sided cross-sectional configuration of the lengthwise portion of the driver 30 passing therethrough can be readily appreciated and is illustratively set forth in FIG. 4. In the embodiment illustrated for exemplary purposes in FIG. 4, the closed and multi-sided marginal edge 66 of opening 65 defined by the end structure 62 and end face 64 of the elastomeric member 42 has an oblong configuration. In the embodiment illustrated for exemplary purposes in FIG. 3, the closed marginal edge 56 of opening 55 defined by the end structure 52 and end face 54 (FIG. 2) of the elastomeric member 42 is shown in dash lines. By configuring the marginal edge 66 of opening 65 defined by the end structure 62 and end face 64 of the elastomeric member 42 differently from the marginal edge 56 of opening 55 defined by the end structure 52 and end face 54 (FIG. 2) of the elastomeric member 42 and to generally correspond in size and shape to the multi-sided cross-sectional configuration of the lengthwise portion of the driver 30 passing therethrough, the area of the end structure 62 and end face 64 impacted against by the piston 16 during operation of gun 10 is significantly increased (as shown in dash lines in FIG. 3) so as to allow the impact area defined by the second end face 64 of member 42 to be optimized to absorb and withstand energy imparted thereto by the piston 16 during operation of the nail gun 10.

An alternative embodiment of an impact or recoil bumper embodying principals and te4achings of the present invention disclosure is illustrated in FIGS. 5 and 6. This alternative form of impact or recoil bumper is generally designated by reference numeral 140. The elements comprising this alternative form of recoil or impact bumper that are identical or analogous to those elements of the recoil or impact bumper 40 discussed above are designated with reference numerals identical to those used above with the exception this alternative embodiment of the impact or recoil bumper uses reference numerals in the one-hundred series.

In the form illustrated by way of example in FIGS. 5 and 6, the recoil or impact bumper 140 includes a rigid, axially elongated and hollow elastomeric member 142 having a first end 150 and axially spaced second end 160. The first end 150 of member 142 includes an end structure 152 defining a generally flat or planar first end face 154 which is adapted to abut against and with a confronting surface on the nail gun body 12 (FIG. 1).

The second end 160 of member includes an end structure 162 defining a generally flat or planar second end face 164 axially spaced from the end face 154 and against which the piston 16 (FIG. 1) impacts during operation of the nail gun 10. In the embodiment illustrated in FIG. 5, the first end structure 152 of bumper 10 has an outer diameter 153 which is greater in diameter than is the outer diameter 163 of the second end structure 162 of bumper 10 (FIG. 6).

To allow a lengthwise portion of the driver 30 to extend through the bumper 140, the first and second end structures 152 and 162, respectively, of member 142 each define a first opening 155 and second opening 165, respectively, which open to both a hollow interior chamber of member 142 and to the first and second end faces 154 and 164, respectively, of member 142. As illustrated in FIG. 5, the first opening 155 defined by the end structure 152 and end face 154 of the elastomeric member 142 has a closed marginal edge 156 which is sized to allow the predetermined cross-sectional configuration of the driver 30 to endwise move therethrough. As illustrated in FIG. 6, the opening 165 defined by the end structure 162 and end face 164 of the elastomeric member 142 has a closed and multi-sided marginal edge 166 which is sized to allow the predetermined cross-sectional configuration of the driver 30 to endwise move therethrough.

As in the first embodiment, the configuration of the closed and multi-sided marginal edge 166 of opening 165 defined by the end structure 162 and end face 164 of the elastomeric member 142 is different in both size and shape from the configuration of the closed marginal edge 156 of opening 155 defined by the end structure 152 and end face 154 of the elastomeric member 42. More specifically, the configuration of the closed marginal edge 166 of opening 165 defined by the end structure 162 and end face 164 of the elastomeric member 142 has a multi-sided configuration which generally corresponds in size and shape to the multi-sided cross-sectional configuration of the lengthwise portion of the drive passing therethrough.

As with the first embodiment, there are distinct advantages which can be realized by configuring the closed marginal edge 166 of opening 165 defined by the end structure 162 and end face 164 of the elastomeric member 142 to generally correspond in size and shape to the multi-sided cross-sectional configuration of the lengthwise portion of the driver 30 passing therethrough. In the embodiment illustrated for exemplary purposes in FIG. 5, the closed marginal edge 166 of opening 165 defined by the end structure 162 and end face 164 of the elastomeric member 142 has four or more sides arranged in a generally square or rectangular pattern relative to each other. In the embodiment illustrated for exemplary purposes in FIG. 5, the closed marginal edge 156 of opening 155 defined by the end structure 152 and end face 154 of the elastomeric member 142 is shown in dash lines. By configuring the closed and multi-sided marginal edge 166 of opening 165 defined by the end structure 162 and end face 164 of the elastomeric member 142 differently from the closed marginal edge 156 of opening 155 defined by the end structure 152 and end face 154 of the elastomeric member 142 and to generally correspond in size and shape to the multi-sided cross-sectional configuration of the lengthwise portion of the driver 30 passing therethrough, the area of the piston 16 impacting against the end structure 152 and end face 154 of the elastomeric member 142 is significantly increased (as shown in dash lines in FIG. 6) so as to allow the impact area defined by the second end face 162 of member 142 to be optimized to absorb and withstand energy imparted thereto by the piston 16 during operation of the nail gun 10.

Figure 7:
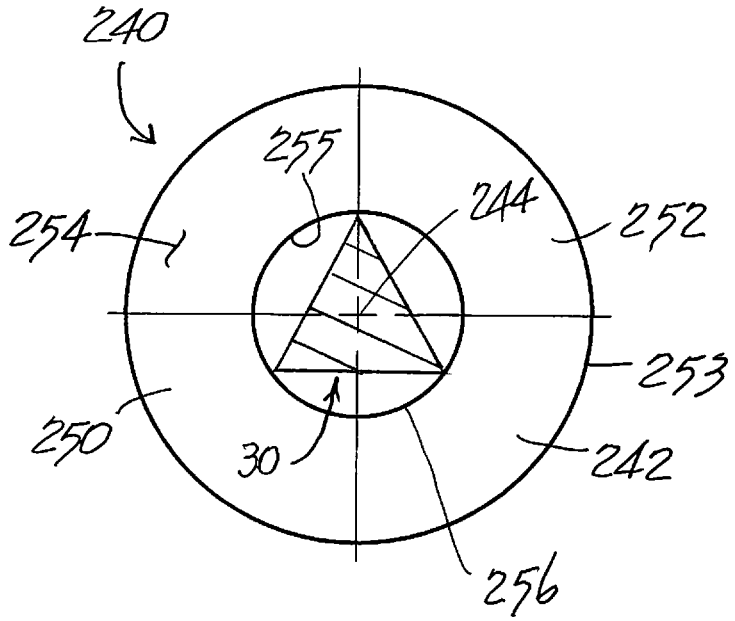
FIG. 7 is a bottom plan view similar to FIG. 3 but showing still another form of recoil bumper embodying principals and teachings of this invention disclosure.
Figure 8:
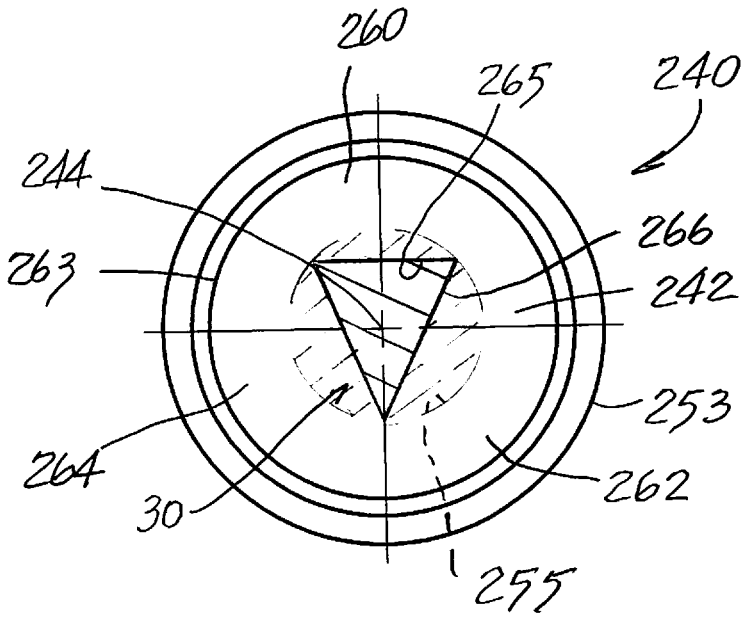
FIG. 8 is a bottom plan view of the recoil bumper illustrated in FIG. 7.

Another alternative embodiment of an impact or recoil bumper embodying principals and te4achings of the present invention disclosure is illustrated in FIGS. 7 and 8. This alternative form of impact or recoil bumper is generally designated by reference numeral 240. The elements comprising this alternative form of recoil or impact bumper that are identical or analogous to those elements of the recoil or impact bumper 40 discussed above are designated with reference numerals identical to those used above with the exception this alternative embodiment of the impact or recoil bumper uses reference numerals in the two-hundred series.

In the form illustrated by way of example in FIGS. 7 and 8, the recoil or impact bumper 240 includes a rigid, axially elongated and hollow elastomeric member 242 having a first end 250 and axially spaced second end 260. The first end 250 of member 242 includes an end structure 252 defining a generally flat or planar first end face 254 which is adapted to abut against and with a confronting surface on the nail gun body 12 (FIG. 1).

The second end 260 of member includes an end structure 262 defining a generally flat or planar second end face 264 axially spaced from the end face 254 and against which the piston 16 (FIG. 1) impacts during operation of the nail gun 10. In the embodiment illustrated by way of example in FIG. 8, the first end structure 252 of bumper 210 has an outer diameter 253 which is greater in diameter than is the outer diameter 263 of the second end structure 262 of bumper 240 (FIG. 8).

To allow a lengthwise portion of the driver 30 to extend through the bumper 240, the first and second end structures 252 and 262, respectively, of member 242 each define a first opening 255 and second opening 265, respectively, which open to both a hollow interior chamber of member 242 and to the first and second end faces 254 and 264, respectively, of member 242. As illustrated in FIG. 7, the first opening 255 defined by the end structure 252 and end face 254 of the elastomeric member 242 has a closed marginal edge 256 which is sized to allow the predetermined cross-sectional configuration of the driver 30 to endwise move therethrough. As illustrated in FIG. 8, the opening 265 defined by the end structure 262 and end face 264 of the elastomeric member 242 has a closed and multi-sided marginal edge 266 which is sized to allow the predetermined cross-sectional configuration of the driver 30 to endwise move therethrough.

As in the first embodiment, the configuration of the closed and multi-sided marginal edge 266 of opening 265 defined by the end structure 262 and end face 264 of the elastomeric member 242 is different in both size and shape from the configuration of the closed marginal edge 256 of opening 255 defined by the end structure 252 and end face 254 of the elastomeric member 242. More specifically, the configuration of the closed marginal edge 266 of opening 265 defined by the end structure 262 and end face 264 of the elastomeric member 142 has a multi-sided configuration which generally corresponds in size and shape to the multi-sided cross-sectional configuration of the lengthwise portion of the driver 30 passing therethrough.

As with the first embodiment, there are distinct advantages which can be realized by configuring the closed marginal edge 266 of opening 265 defined by the end structure 262 and end face 264 of the elastomeric member 242 to generally correspond in size and shape to the multi-sided cross-sectional configuration of the lengthwise portion of the driver 30 passing therethrough. In the embodiment illustrated for exemplary purposes in FIG. 8, the closed marginal edge 266 of opening 265 defined by the end structure 262 and end face 264 of the elastomeric member 142 has multiple sides arranged in a generally triangular pattern relative to each other. In the embodiment illustrated for exemplary purposes in FIG. 7, the closed marginal edge 256 of opening 255 defined by the end structure 252 and end face 254 of the elastomeric member 242 is shown in dash lines. By configuring the closed and multi-sided marginal edge 266 of opening 265 defined by the end structure 262 and end face 264 of the elastomeric member 242 differently from the closed marginal edge 256 of opening 255 defined by the end structure 252 and end face 254 of the elastomeric member 242 and to generally correspond in size and shape to the multi-sided cross-sectional configuration of the lengthwise portion of the driver 30 passing therethrough, the area of the piston 16 impacting against the end structure 252 and end face 254 of the elastomeric member 242 is significantly increased (as shown in dash lines in FIG. 8) so as to allow the impact area defined by the second end face 262 of member 242 to be optimized to absorb and withstand energy imparted thereto by the piston 16 during operation of the nail gun 10.

From the forgoing, it will be observed numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated and discussed. Rather, this disclosure is intended to cover by the appended claims all such modifications and variations as fall within the spirit and scope of the claims.

What is claimed is:

1. A recoil bumper for a nail gun having a body, an elongated cylinder disposed within the body of said nail gun, a piston slidably movable in a cylinder in the body of said nail gun, a driver moved by said piston and having a multi-sided cross-sectional configuration axially extending along at least a lengthwise portion thereof, and with one end of said driver protruding out of the body of said nail gun for punching against a nail in accordance with downward movement of the piston, said recoil bumper comprising:

a one-piece hollow elastomeric member through which said lengthwise portion of said driver endwise passes, said elastomeric member having a first end defining a first end face which abuts with the nail gun body and a second end defining a second end face axially spaced from said first end face and against which said piston impacts during operation of said nail gun, with said elastomeric member further having an axially elongated energy absorbing section disposed between said first end face and said second end face of said elastomeric member, with said energy absorbing section of said elastomeric member being in the form of a ring having a wall whose inner surface is radially spaced from the multi-sided cross-sectional configuration of said driver, with the first end face of said elastomeric member defining a first opening having a first closed marginal edge, and with the second end face of said elastomeric member defining a second opening having a second closed marginal edge, with the closed marginal edge of the first and second openings being different from each other, with the second end of said elastomeric member including lip structure extending radially inward from an end of the energy absorbing section and terminating at the second closed marginal edge of the second opening, and with the closed marginal edge of the second opening having a multi-sided configuration substantially matching the cross-sectional configuration of that lengthwise portion of said driver passing therethrough such that an impact area defined by the second end face is optimized to withstand impacts imparted thereto by said piston during operation of said nail gun.

2. The recoil bumper according to claim 1, wherein said elastomeric member defines a longitudinal axis for said recoil bumper, with the first and second openings defined by said elastomeric member being coaxially aligned relative to the longitudinal axis of said recoil bumper.

3. The recoil bumper according to claim 1, wherein the second opening defined by said elastomeric member has a substantially oblong marginal edge configuration, in plan.

4. The recoil bumper according to claim 1, wherein the second opening defined by said elastomeric member has a substantially square marginal edge configuration, in plan.

5. The recoil bumper according to claim 1, wherein the second opening defined by said member has a substantially triangular marginal edge configuration, in plan.

6. The recoil bumper according to claim 1, wherein the second opening defined by said elastomeric member has a substantially rectangular marginal edge configuration, in plan.

7. The recoil bumper according to claim 1, wherein said elastomeric member is formed from a thermoplastic elastomer having a Shore D hardness ranging between 40 and 70.

8. The recoil bumper according to claim 1, wherein the axially elongated energy absorbing section comprises between 45% and 70% of an overall length of said recoil bumper.

9. The recoil bumper according to claim 1, wherein the axially elongated energy absorbing section of said recoil bumper has a lateral outer face which curves outwardly toward an exterior of said recoil bumper whereby yielding a substantially toroidal shape to said energy absorbing section of said recoil bumper.

10. The recoil bumper according to claim 1, wherein the wall of said axially elongated energy absorbing section of said recoil bumper has a substantially constant cross-sectional thickness.

11. A recoil bumper for a nail gun having a body, an elongated cylinder disposed within the body of said nail gun, a piston slidably movable in a cylinder in the body of said nail gun, a driver operably connected to said piston and having a multi-sided cross-sectional configuration axially extending along at least a lengthwise portion thereof, and with one end of said driver protruding out of the body of said nail gun for punching against a nail in accordance with downward movement of the piston, said recoil bumper comprising:

a one-piece axially elongated and hollow elastomeric member through which a lengthwise portion of said driver endwise passes, said elastomeric member having first and second ends with an axially elongated energy absorption section extending therebetween, with the first end of said elastomeric member defining a first end face adapted to abut with the nail gun body, and with the second end of said elastomeric member defining a second end face against which said piston impacts during operation of said nail gun, with the first end face of said elastomeric member defining a first opening having a first closed marginal edge, and with the second end face of said elastomeric member defining a second opening having a second closed marginal edge, with the marginal edge of the first and second openings being different from each other, with the second end of said elastomeric member including lip structure extending radially inward from an end of the energy absorbing section and terminating at the second closed marginal edge of the second opening, and with the second closed marginal edge of the second opening having a multi-sided configuration substantially matching the cross-sectional configuration of that lengthwise portion of said driver passing therethrough such that an impact area defined by the second end face of said elastomeric member is optimized to withstand impacts imparted thereto by said piston during operation of said nail gun while inhibiting material deformation of the second end of said elastomeric member.

12. The recoil bumper according to claim 11, wherein said elastomeric member defines a longitudinal axis for said recoil bumper, with the first and second openings defined by said elastomeric member being coaxially aligned relative to the longitudinal axis of said recoil bumper.

13. The recoil bumper according to claim 11, wherein the second closed marginal edge of the second opening defined by said elastomeric member has a substantially oblong configuration, in plan.

14. The recoil bumper according to claim 11, wherein the second closed marginal edge of the second opening defined by said elastomeric member has a configuration including four or more sides, in plan.

15. The recoil bumper according to claim 11, wherein the second opening defined by said elastomeric member has a substantially triangular marginal edge configuration, in plan.

16. The recoil bumper according to claim 11, wherein said elastomeric member is formed from a thermoplastic elastomer having a Shore D hardness ranging between 40 and 70.

17. The recoil bumper according to claim 11, wherein the axially elongated energy absorbing section comprises between 45% and 70% of an overall length of said recoil bumper.

18. The recoil bumper according to claim 11, wherein the axially elongated energy absorbing section of said recoil bumper has a lateral outer face which is curved outwardly toward an exterior of said recoil bumper whereby yielding a substantially toroidal shape to said energy absorbing section of said recoil bumper.

19. The recoil bumper according to claim 11, wherein the axially elongated energy absorbing section of said recoil bumper has a wall with a substantially constant cross-sectional thickness.

20. A recoil bumper for a nail gun having a body, an elongated cylinder disposed within the body of said nail gun, a piston slidably movable in a cylinder in the body of said nail gun, a driver connected to said piston and having a multi-sided cross-sectional configuration axially extending along at least a lengthwise portion thereof, and with one end of said driver protruding out of the body of said nail gun for punching against a nail in accordance with downward movements of the piston, said recoil bumper comprising:

a one-piece elongated and rigid elastomeric member through which a lengthwise portion of said driver endwise passes, said elastomeric member having a first end, a second end, and an axially elongated energy absorbing section between said ends, with the energy absorbing section of said elastomeric member defining an interior chamber, said elastomeric member having end structure at each of said first and second ends for at least partially closing said interior chamber, with the end structure at the first end of said elastomeric member abutting against the body of said nail gun and defines a first opening having a first closed marginal edge, and with the end structure at the second end of said elastomeric member abutting with said piston during operation of said nail gun and defines a second opening having a second closed marginal edge, with the closed marginal edge of the first and second openings being different from each other, with the second end of said elastomeric member including lip structure extending radially inward from an end of the energy absorbing section and terminating at the second closed marginal edge of the second opening, and with the second closed marginal edge of the second opening having a multi-sided configuration substantially corresponding to the cross-sectional configuration of that lengthwise portion of said driver passing therethrough such that an impact area defined by the end structure at the second end of said elastomeric member is optimized to withstand impacts imparted thereto by said piston during operation of said nail gun.

21. The recoil bumper according to claim 20, wherein said elastomeric member defines a longitudinal axis for said recoil bumper, with the first and second openings defined by said elastomeric member being coaxially aligned relative to the longitudinal axis of said recoil bumper.

22. The recoil bumper according to claim 20, wherein the second closed marginal edge of the second opening defined by the second end structure of said elastomeric member has a substantially oblong edge configuration, in plan.

23. The recoil bumper according to claim 20, wherein the second closed marginal edge of the second opening defined by the second end structure of said elastomeric member has a configuration with four or more sides, in plan.

24. The recoil bumper according to claim 20, wherein the second closed marginal edge of the second opening defined by the second end structure of said elastomeric member has a substantially triangular configuration, in plan.

25. The recoil bumper according to claim 20, wherein said elastomeric member is formed from a thermoplastic elastomer having a Shore D hardness ranging between 40 and 70.

26. The recoil bumper according to claim 20, wherein the axially elongated energy absorbing section comprises between 45% and 70% of an overall length of said recoil bumper.

27. The recoil bumper according to claim 20, wherein the axially elongated energy absorbing section of said recoil bumper has a lateral outer face which is curved outwardly toward an exterior of said recoil bumper whereby yielding a substantially toroidal shape to said energy absorbing section of said recoil bumper.

28. The recoil bumper according to claim 20, wherein the axially elongated energy absorbing section of said recoil bumper has a wall with a substantially constant cross-sectional thickness.

29. A recoil bumper for a nail gun having a body, an elongated cylinder disposed within the body of said nail gun, a piston slidably movable in a cylinder in the body of said nail gun, a driver moved by said piston and having a multi-sided cross-sectional configuration axially extending along at least a lengthwise portion thereof, and with one end of said driver protruding out of the body of said nail gun for punching against a nail in accordance with downward movement of the piston, said recoil bumper comprising:

a one-piece elongated and rigid elastomeric member through which a lengthwise portion of said driver endwise passes, said elastomeric member having a first end and a second end and define an interior chamber, with said elastomer member having an energy absorbing section extending between said ends, and with said elastomeric member having end structure at each of said first and second ends for at least partially closing said interior chamber, with the end structure at the first end of said elastomeric member abutting against the body of said nail gun and defines a first opening having a first closed marginal edge, and with the end structure at the second end of said elastomeric member abutting with said piston during operation of said nail gun and defines a second opening having a second closed marginal edge, with the closed marginal edge of the first and second openings being different from each other, and wherein the end structure at the second end of said elastomeric member includes a lip formed integral with said elastomeric member and extending radially inward from the end of the energy absorbing section and terminating at the closed marginal edge of the second opening.

30. The recoil bumper according to claim 29, wherein said elastomeric member defines a longitudinal axis for said recoil bumper, with the first and second openings defined by said elastomeric member being coaxially aligned relative to the longitudinal axis of said recoil bumper.

31. The recoil bumper according to claim 29, wherein the first and second openings defined by the first and second end structures, respectively, of said elastomeric member have different marginal edge configurations relative to each other.

32. The recoil bumper according to claim 29, wherein the second closed marginal edge of the second opening defined by the second end structure of said elastomeric member has a multi-sided configuration, in plan.

33. The recoil bumper according to claim 29, wherein said elastomeric member is formed from a thermoplastic elastomer having a Shore D hardness ranging between 40 and 70.

34. The recoil bumper according to claim 29, wherein the axially elongated energy absorbing section of said recoil bumper has a lateral outer face which is curved outwardly toward an exterior of said recoil bumper whereby yielding a substantially toroidal shape to said energy absorbing section of said recoil bumper.

* * * * *